US006062771A

United States Patent [19]

Roberts

[11] Patent Number: 6,062,771

[45] Date of Patent: May 16, 2000

[54] PILING AND METHOD FOR DRIVING AND SETTING THE PILING IN-SITU

[76] Inventor: Kenneth B. Roberts, 3832 E. Loyola Dr., Kenner, La. 70065

[21] Appl. No.: 09/072,377

[22] Filed: May 4, 1998

Related U.S. Application Data

[63] Continuation-in-part of application No. 08/880,270, Jun. 23, 1997, abandoned.

[51] Int. Cl.[7] ..... E02D 5/74

[52] U.S. Cl. ..... 405/244; 405/232; 405/255; 52/155; 52/159

[58] Field of Search ..... 405/232, 244, 405/255; 52/153, 154, 155, 156, 160, 161, 162; 292/204, 54; 403/332, 326

[56] References Cited

U.S. PATENT DOCUMENTS

| | | | |
|---|---|---|---|
| Re. 12,385 | 8/1905 | Bruley | 52/155 |
| 1,551,506 | 8/1925 | Parsons | 292/54 X |
| 1,796,147 | 3/1931 | Green et al. | 52/161 |
| 1,982,687 | 12/1934 | O'Brien | 52/160 X |
| 2,396,276 | 3/1946 | Lang | 52/161 |
| 2,431,608 | 11/1947 | Clapper | 52/161 |
| 2,660,276 | 11/1953 | McKee | 52/159 |
| 2,672,961 | 3/1954 | Mead et al. | 52/159 |
| 2,881,591 | 4/1959 | Reeve | 52/159 |
| 3,115,226 | 12/1963 | Thompson, Jr. | 405/244 X |
| 3,248,888 | 5/1966 | Williams | 405/232 |
| 3,324,666 | 6/1967 | Lee | 405/244 X |
| 4,428,606 | 1/1984 | Proffer | 292/181 |
| 5,108,068 | 4/1992 | Gingras | 52/160 X |
| 5,203,596 | 4/1993 | Stevens | 292/204 |

FOREIGN PATENT DOCUMENTS

| | | | |
|---|---|---|---|
| 2131071 | 6/1984 | United Kingdom | 405/244 |
| 1809080 | 4/1993 | United Kingdom | 405/232 |

*Primary Examiner*—David Bagnell
*Assistant Examiner*—Jong-Suk Lee
*Attorney, Agent, or Firm*—Domingue & Waddell, PLC

[57] ABSTRACT

A novel piling comprises a tubular member containing a plurality of passages therein. The piling includes a first rod longitudinally placed within the inner diameter of the tubular member, with the first rod having a first plurality of blades attached thereon. The first plurality of blades will be aligned with the plurality of passages. The piling also includes a gripping member adapted for rotating the blades from the inner diameter of the tubular member to an extended position protruding through the passages. The gripping member consist of a first gripping surface formed on the first end of the first rod and a rod holder, operatively attached to the second end of the tubular member. The rod holder will contain the second end of the rod so that the first rod may be rotated by a turning of the first gripping surface. The novel piling may also include a second plurality of passages therein, along with a second rod longitudinally placed within the inner diameter of the tubular member and adjacent the first rod. The second rod will have a second plurality of blades attached thereon. The blades (and associated passages) of the first rod will be staggered relative to the blades (and associated passages) of the second rod so that the first and second rod cooperate with one another. A method of driving a piling into a ground surface is also disclosed.

15 Claims, 6 Drawing Sheets

PILING AND METHOD FOR DRIVING AND SETTING THE PILING IN-SITU

CROSS REFERENCE TO RELATED APPLICATIONS

This application is a continuation-in-part of U.S. patent application Ser. No. 08/880,270, filed Jun. 23, 1997, now abandoned.

BACKGROUND OF THE INVENTION

The present invention relates generally to a piling, and more particularly is directed towards a piling for supporting weight of buildings, houses, bridges and so on. The present invention is an elongated hollow member made of any material to be a piling. The invention has a mechanism that forces a plurality of apparatus (blades) to extrude from the center diameter of said piling to the outer diameter; after said piling is installed into the ground. The present invention will be more stable, and, most importantly, support more weight than any conventional piling, equal in length and diameter, because the apparatus extruding from the said piling will cause friction between said apparatus, that no known conventional piling has today. This will be helpful in many areas of the world. The invention is a totally new concept and should help the building industry tremendously. This application, which is a continuation-in-part of application Ser. No. 08/880,270, is incorporated herein by reference hereto.

Pilings are generally made of wood, concrete, steel and plastic. Wood pilings are plagued by wear and tear, and are attached by wood goring marine organisms. Wood pilings are typically treated with creosote, but even this material can be ineffective against modern marine borers, steel pilings are a hollow pipe, and filled with a material such as concrete. Concrete pilings are made of different shapes, triangle, square, and round. They even have one shaped like a screw. All of these pilings are considered to be friction piling. The longer, the rounder, or the wider the more friction. The more weight the piling will support. All in equal size will support about the same amount of weight. None of these pilings have apparatus extruding from the inner diameter to the outer diameter of the piling. So there is no piling or patent to compare with this invention. The conventional piling today hasn't had many changes over the years. They have devised ways of connecting them to go deeper into the ground, also, methods of installing them have been devised. The invention herein disclosed is totally different in every aspect, except the fact that it is a piling. The only similarity is the friction buildup around the sides that all pilings have. This invention has a substantially new area to create friction. The conventional piling only has friction around the sides. This invention has that, plus the added friction of the blades extending outward from the piling.

SUMMARY OF THE INVENTION

An elongated hollow member of predetermine size or material to be a piling. It overcomes disadvantages of prior art. The invention has unique benefits as described in detail below.

The present invention is an elongated hollow member made of predetermine size, and material, that has a mechanism that causes a plurality of apparatus to protrude from the center diameter of said piling to the outer diameter after said piling is installed into the ground. A top cap of predetermine size and material, said cap has two holes across from one another attached to said piling. A bottom cap of predetermine size and material, connect to said cap will be two rod holders of predetermine size and material, connected to said bottom cap. Two rod holders will be opposite one another in line directly below the holes in the said top cap. Two rods of predetermine size and material, said rods will sit into rod holders and extend the length of said piling, and protrude through said holes in the top cap. A rod hex head will be attached to said rods above said top cap, so when turned, rods will turn in said rod holders. A plurality of apparatus of predetermine size and material will be attached to said rods staggered from one rod to another. Holes in said piling of predetermine size level with each apparatus, so when said hex head is turned, the apparatus will protrude from within the center of said piling to the outer diameter.

In one of the preferred embodiments, the piling will comprise a tubular member containing an inner diameter and an outer diameter. The tubular member will contain a plurality of passages therein. The piling will also contain a first rod longitudinally placed within the inner diameter of the tubular member, with the first rod having a first plurality of blades attached thereon. The first plurality of blades will be aligned with the plurality of passages.

The piling also includes a means for moving the blades from the inner diameter of the tubular member to an extended position protruding through the passages. The rotating means will consist of a first gripping surface formed on the first end of the first rod and a rod holder, operatively attached to the second end of the tubular member. The rod holder will contain the second end of the rod so that the first rod may be rotated by a turning of the first gripping surface.

In the preferred embodiment, the tubular member further includes a second plurality of passages therein, along with a second rod longitudinally placed within the inner diameter of the tubular member and adjacent the first rod. The second rod will have a second plurality of blades attached thereon. The blades (and associated passages) of the first rod will be staggered relative to the blades (and associated passages) of the second rod so that the first and second rod cooperate with one another. Also, the second rod will contain a first and second end, with a second gripping surface formed on the first end. In this embodiment, the second end of the rod is contained within the rod holder so that the second rod may be rotated by a turning of the second gripping surface.

The piling may further comprise a pound cap positioned on the first end of the tubular member, with the pound cap being configured and adapted to allow the striking of the cap by a driving mechanism (such as a hammer) in order to drive the pile into the surface of the ground. The piling may further comprise a conical member positioned on the second end of the tubular member, with the conical member adapted to allow for the driving of the piling into the ground surface.

A method of driving a piling into a ground surface is also disclosed. The piling will include a tubular member containing an inner diameter and an outer diameter with a first rod longitudinally placed within the inner diameter of the tubular member. The first rod will have a first plurality of blades attached thereon. The method, therefore, comprises the steps of striking a first end of the piling with a hammer means so that the tubular member is driven to and positioned at a desired depth. Next, the operator would terminate the striking by the hammer means, and then, turn the gripping end of the first rod so that the rod rotates within the inner diameter of the tubular member. The method includes passing the plurality of blades through a plurality of passages contained within the tubular member, and thereafter, urging the plurality of blades radially outward into the ground surface.

In the preferred embodiment, the tubular member further contains a rod holder, operatively attached to a second end of the tubular member, and wherein the rod holder contains the second end of the first rod. Hence, the step of turning the gripping end comprises rotating the second end of the first rod within the rod holder. Also, the piling may further comprises a second rod longitudinally placed within the inner diameter of the tubular member. This second rod will have a second plurality of blades attached thereon. The method further comprises turning a gripping end of the second rod so that the second rod rotates within the inner diameter of the tubular member, and thereafter, passing the second plurality of blades through a second plurality of passages contained within the tubular member. This step urges the second plurality of blades into the ground surface.

In another embodiment, the blades comprises a first section, with the first section being attached to the rod, and a second section that extends from the first section, with the second section concluding with a tip. In this embodiment, the step of passing the blades through the passages includes passing the second section through the passages; and, the step of urging the blades includes urging the tip into the ground surface.

An advantage of the present invention includes significantly increasing the compressive strength of the driven pile. Another advantage includes significantly increasing the tensile strength of the driven pile. Yet another advantage is the ability to rotate the rod from the surface in order to activate the blades into engagement with the ground. Still yet another advantage is the capability to rotate the rod from the surface to retract the blades into the inner diameter. Yet another advantage includes the novel piling of the present invention will be able to support more weight than a prior art piling of equal height.

A feature of the present invention includes having the anchoring mechanism on inner diameter of the pile before deployment. Another feature includes having an anchoring mechanism that may be a single blade attached to a longitudinal mounted rod. Yet another feature consist of an anchoring mechanism that may be a plurality of blades attached to a longitudinally mounted rod or a pair of rods.

Still yet another feature entails a means for moving the anchoring mechanism (blades) radially outward into the ground via a gripping member connected to one end of the rod. In one embodiment, the gripping member is a hex head type of bolt which can be turned by conventional means such as a wrench means. Yet another feature entails a staggered configuration of blades on the first rod relative to the second rod. Another feature includes the size of the passages being selected so that the blade can be rotated radially outward from the inner diameter of the piling.

BRIEF DESCRIPTION OF THE DRAWINGS

FIG. 5B is a plan view cross-section of the top cap member of FIG. 5A.

DETAILED DESCRIPTION OF THE PREFERRED EMBODIMENTS

Figure 1:
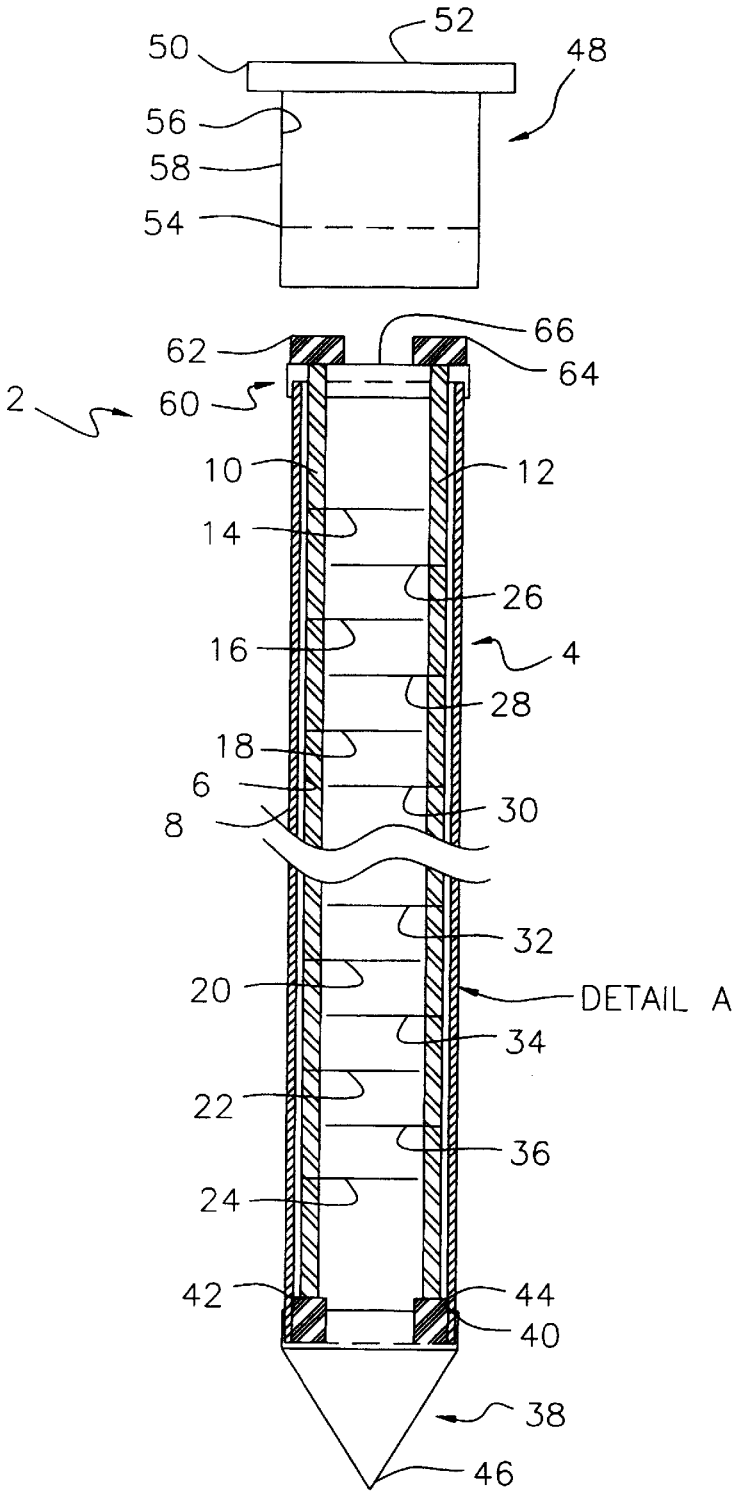
FIG. 1 is an elevation view of the preferred embodiment of the present invention.

Referring now to FIG. 1, the preferred embodiment of the present invention will now be described. Generally, the novel piling 2 will comprise a tubular member 4, with the tubular member 4 having an inner diameter 6 and an outer diameter 8. It should be noted that while a tubular member is shown, other shapes are applicable such as triangular or rectangular. The inner diameter will have disposed therein a first rod 10 and a second rod 12, with the first rod 10 and second rod 12 being disposed longitudinally within the tubular member 4.

The first rod 10 will have disposed thereon a series of blades (sometimes referred to as anchors), including blades 14, 16, 18, 20, 22, 24. The second rod 12 will have disposed thereon a series of blades (sometimes referred to as anchors), including blades 26, 28, 30, 32, 34, 36. As shown, the blades 14–36 are disposed in the inner diameter 6.

The blades 14–36 are in a staggered configuration such that blade 14 is located on rod 10 while the next preceding blade 26 is attached to the rod 12. The next preceding blade is blade 16 which is on rod 10 while the next preceding blade is blade 28 which is on rod 12 and so on. The tubular member 4 will contain a series of passages or openings within its wall. The passages will be aligned and arranged with the individual blades so that as the rods 10, 12 are rotated, the individual blades pass through their respective passages so that the blades protrude from the outer diameter 8.

FIG. 1 also depicts the conical member 38 that is also referred to as the v-cap 38. The v-cap 38 has disposed at one end a rod holder 40 for holding the rods 10, 12, and allowing the rods 10, 12 to be rotated therein, as will be explained later in the application. The rod holder 40 contains a first projection 42 and a second projection 44, with the projections receiving the ends of rods 10, 12 as depicted in FIG. 1. The v-cap 38 proceeds to the tip 46. With the conically shaped member 38, the driving of the novel pile is facilitated as will be appreciated by those of ordinary skill in the art. The rod holders 40 may be welded or molded in the inside diameter against the inner wall of the piling. This will make the blades extend further outward. Also, in one embodiment, multiple rod holders may be used. The rod holders may be placed approximately every 10 feet apart on the inside wall of the piling. The extra rod holders (not shown) that would have the rods disposed therethrough are added because the center blades and rod has a tendency to bow towards the inside if there is no supporting rod holder sequentially spaced every 10 feet or so. The actual spacing of the added rod holders is dependent on such factors as pile length, pile diameter, rod length, rod diameter, ground conditions, etc.

Also illustrated in FIG. 1 is the pound cap 48. The pound cap 48 is adapted at the top end of the tubular member 4 so that it may be struck by a hammer means for driving the pile 2 into the ground surface. Generally, the pound cap 48 has a first section 50 containing a radially flat surface 52. The first section 50 extends to a second section 54 that contains an inner diameter 56 and an outer diameter 58, with the inner diameter 56 being generally placed over the top end of the tubular member 4.

The invention also contains rotating means for rotating the rods, which is seen generally at 60. The rotating means includes a hex head type of gripping surface 62, with the gripping surface 62 being operatively attached to the end of rod 10, as well as the hex head type of gripping surface 64, with the gripping surface 64 being operatively attached to the end of rod 12. Also included is a top coupling member 66 that is positioned at the end of the tubular member 4 and aligns and stabilizes the rods 10, 12. Therefore, the gripping surface 62, 64 may be turned by conventional means, such as a wrench, which in turn will rotate the rods 10, 12 thereby turning the blades 14–36.

Figure 2C:
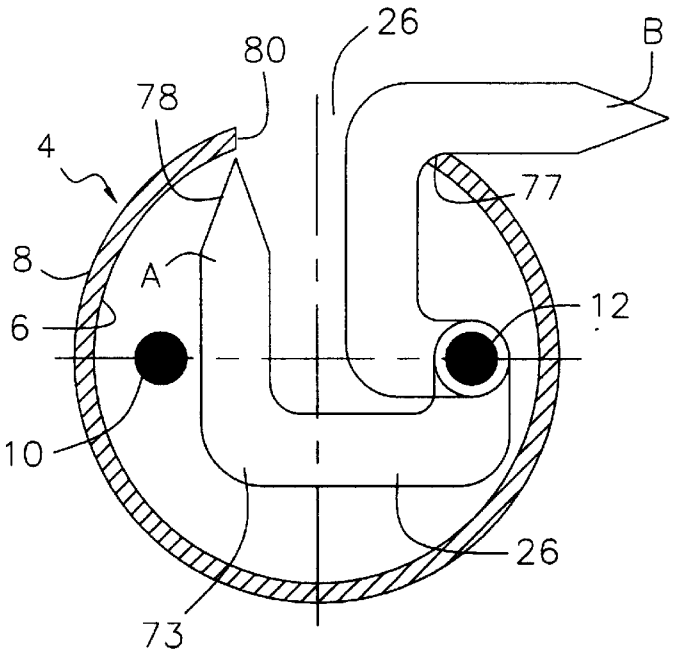
FIG. 2C is a section cut plan view of the blade of FIG. 2C being rotated to an extended position.
Figure 2A:
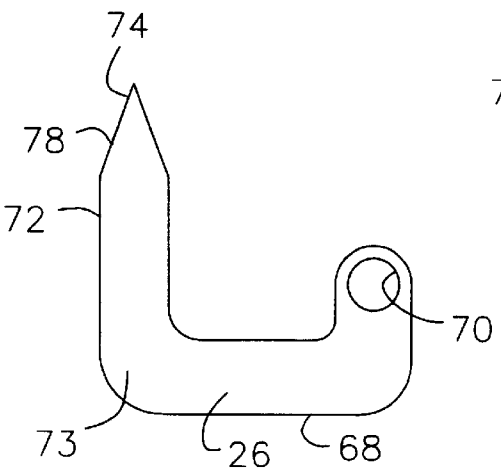
FIG. 2A is a detailed plan view of the blade of the present invention.

Referring now to FIG. 2A, a typical blade used herein will be described. It should be noted that like numbers appearing in the various figures refer to like components. The blade 26 is exemplary of the other blades herein disclosed. The blade 26 will contain a first section 68 that is disposed generally in a first direction. The first section 68 will contain an opening 70, with the opening 70 adapted to have the rod 12 fitted therethrough. The blade 26 will be attached to the rod 12 by conventional means such as welding. The first section 68 will extend to the second section 72 that is disposed in a second direction, with the second direction being generally at a right angle and perpendicular to the direction of the first section. With this configuration, it is possible that the entire blade be disposed within the inner diameter 6 of the tubular member 4. The second section 72 extends to the point member 74, with the point member 74 being adapted for penetration into the ground surface upon extension of the blade 14 as per the teachings of the present invention.

Figure 2B:
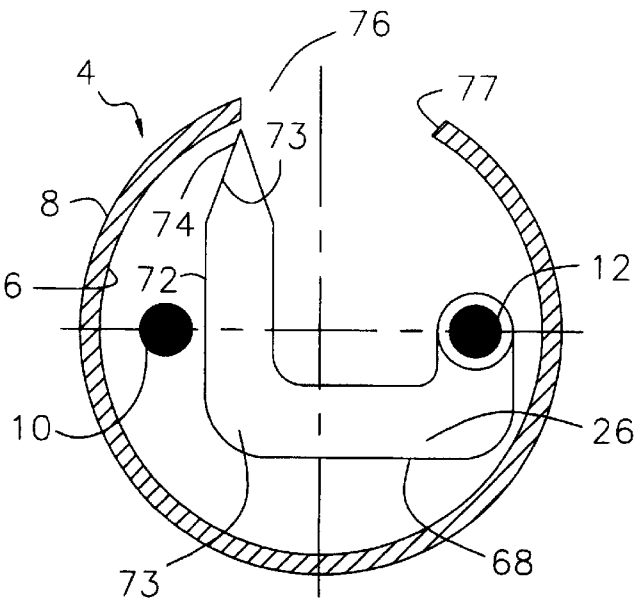
FIG. 2B is a section cut plan view of the blade of FIG. 2A within the inner diameter of the novel piling.
Figure 2D:
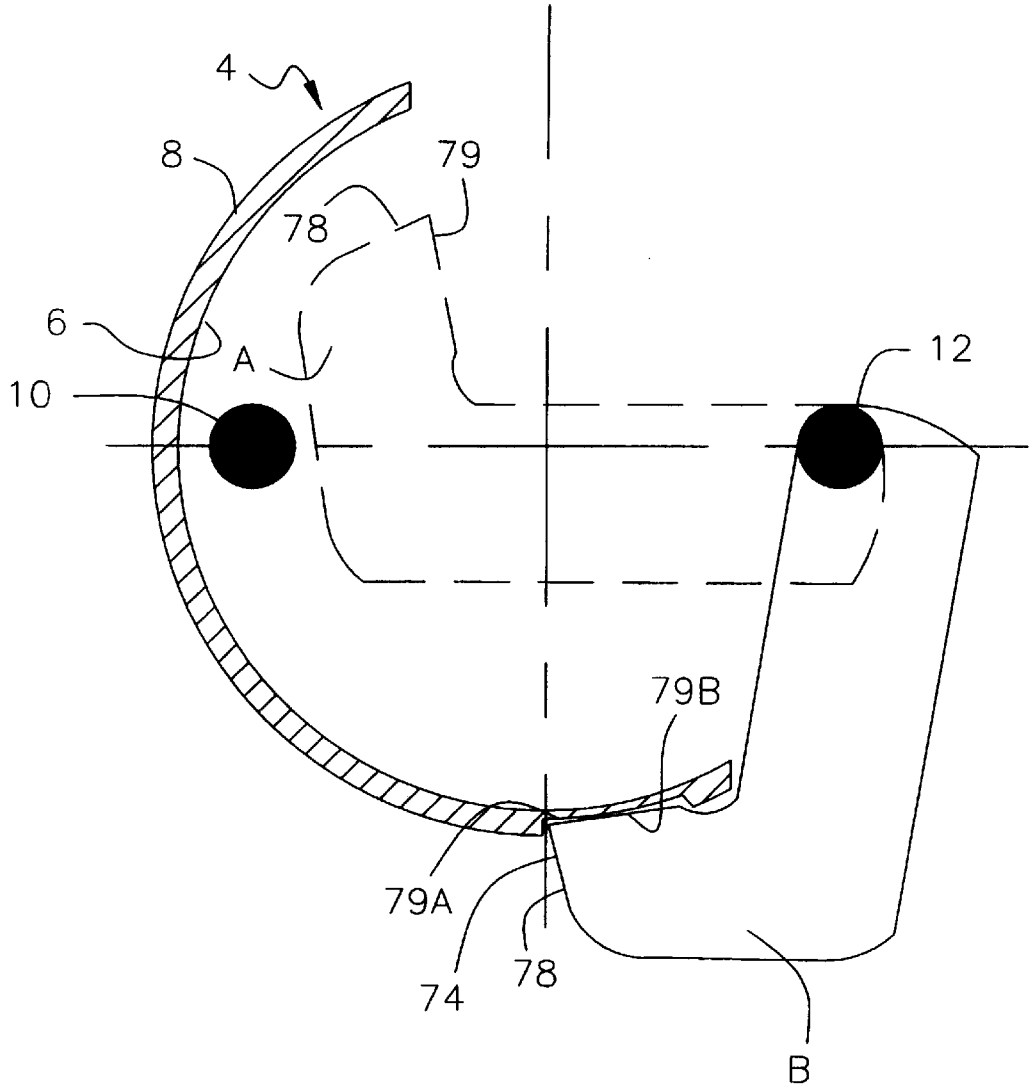
FIG. 2D is a section cut plan view of a second embodiment of the blade of FIG. 2A with a locking groove configured on the tubular member.

As per FIG. 2D, in the preferred embodiment, there is placed on the outer wall of the piling a notch/groove 79*a*, with the groove 79*a* being configured and placed to receive the tip side 79*b*. The tip side 79*b* will extend into this groove 79*a* as shown in FIG. 2*d*. By having the blade fit into this groove upon extension, the blades are further stabilized and it also makes the blades and piling act more as a single member. Each of the plurality of blades may have associated therewith a notch/groove that upon extension will cooperate therewith as a locking groove.

With reference to FIG. 2B, the blade 14 of FIG. 2A is depicted within the inner diameter 6. The FIG. 2B also illustrates the passage 76 that is aligned with the blade 14 and allows passage of the blade 14 upon rotation of the rod 12. In FIG. 2C, the blade 14 is illustrated in the first position A which corresponds to the blade 26 being in the retracted position within the inner diameter 6. The FIG. 2C also represents the blade 26 being in the second position B which corresponds to the blade 26 being in the extended position protruding from the member 4. The length of sections 72, 68 is chosen so that the corner 73 will contact the passage way end 77. As shown, the passage is sized so that the blade 26 may be swept through the passage to a fully extended position. Notice that the shaved portion 78 of point 74 allows passage through the passage end 80.

Figure 3A:
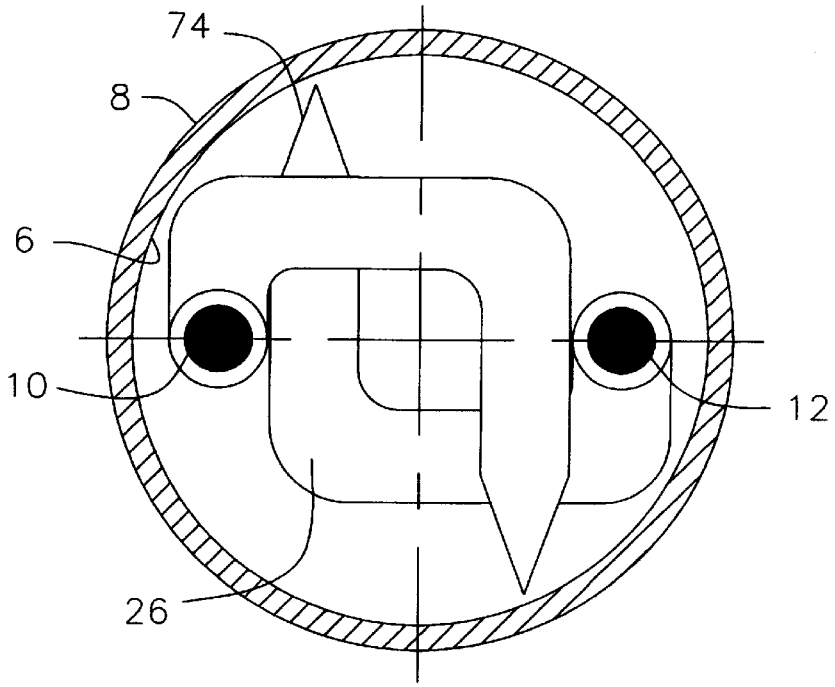
FIG. 3A is a section cut plan view a pair of blades being positioned within the novel piling.
Figure 3B:
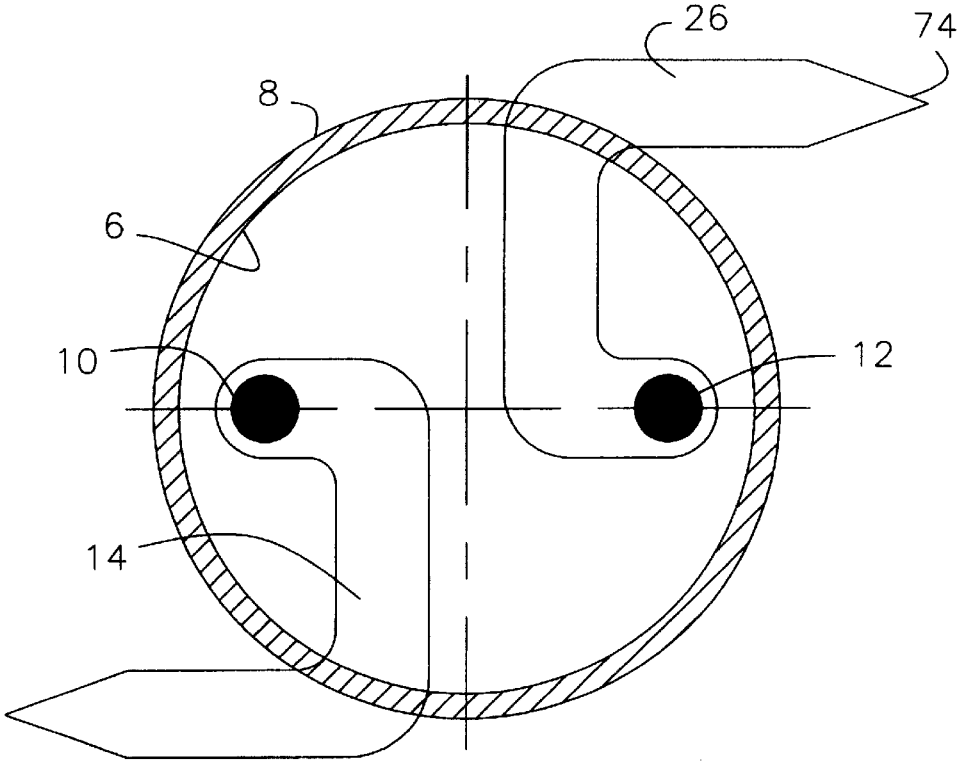
FIG. 3B is a section cut plan view of the pair of blades of FIG. 3A being rotated to an extended position.

In FIG. 3A, a cross-section view of the piling depicts the blades 14 and 26 in the closed position within the inner portion 6. As illustrated, the blade 14 is attached to the rod 10 and the blade 26 is attached to the rod 12 in a staggered relationship. The blade 14 will pass through a passage (not shown) in the tubular member, with said passage being aligned and arranged so that the blade 14 may pass therethrough as was the case with the passage 76 and blade 26. The FIG. 3B depicts the blades 14 and 26 being in the second position, which corresponds to the open position so that the blades 14 and 26 protrude from the tubular member 4 through their respective passages. The position of FIG. 3B corresponds to the location after extension by the rotating means.

Figure 4B:
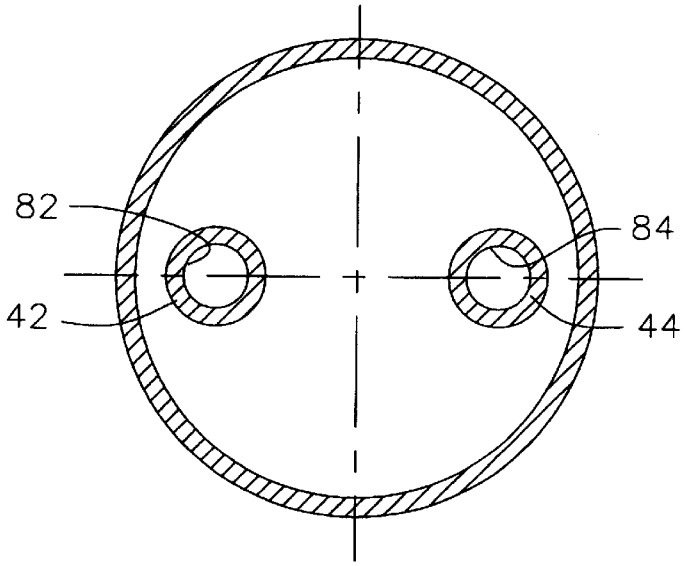
FIG. 4B is a plan view cross-section of the lower cap of FIG. 4A.
Figure 4A:
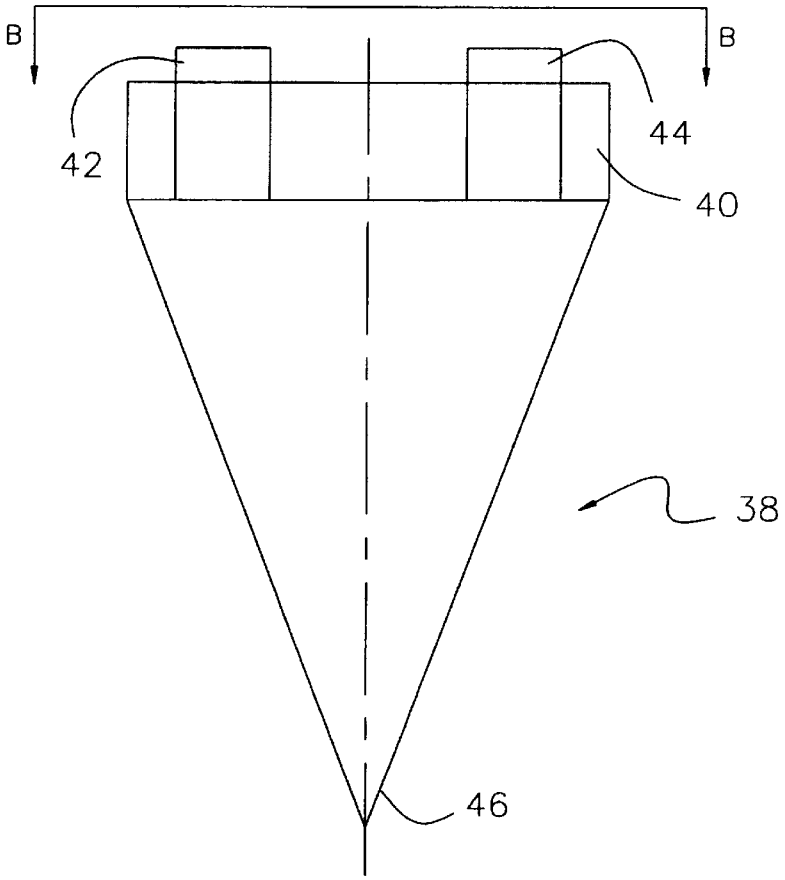
FIG. 4A is a detailed elevation view of the lower cap that is positioned on the piling of the present invention.

The FIG. 4A will depict the v-cap member 38 (conical member) containing the rod holder 40 at one end and the point 46 at the other end. The rod holder 40, as mentioned earlier, will contain the projection 42 that will receive the rod 10 and allow rotation thereof. Also shown is the projection 44 that will receive the rod 12 and allow rotation thereof. The FIG. 4B depicts the top plan view of the v-cap 38 illustrated in FIG. 4A. As shown, the projection 42 contains the inner cylindrical profile 82 for receiving the rod 10 and the projection 44 contains the inner cylindrical profile 84 for receiving the rod 12.

Figure 5B:
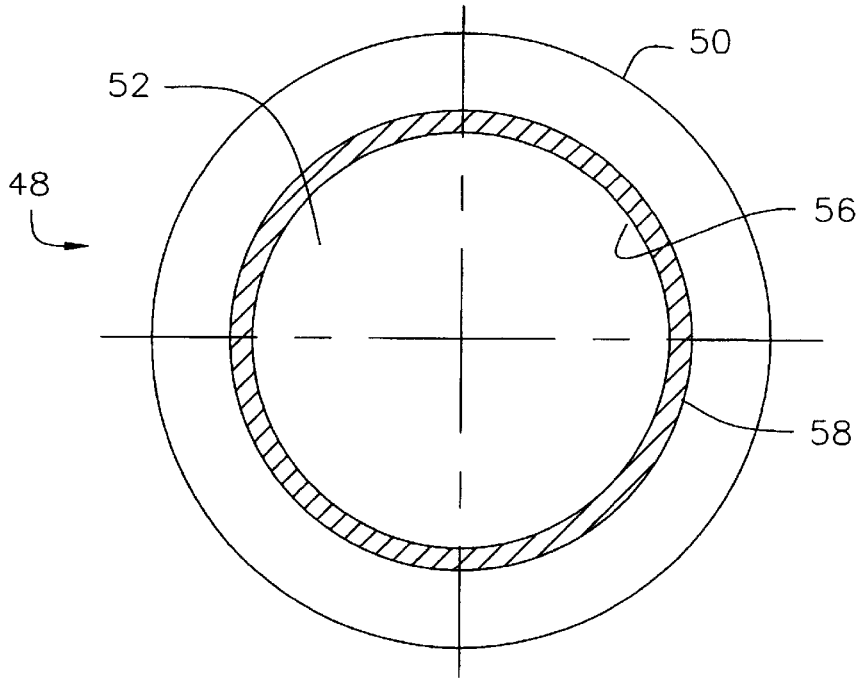
FIG. 5B is a detailed elevation view of the top cap member that is positioned on the novel piling.
Figure 5A:
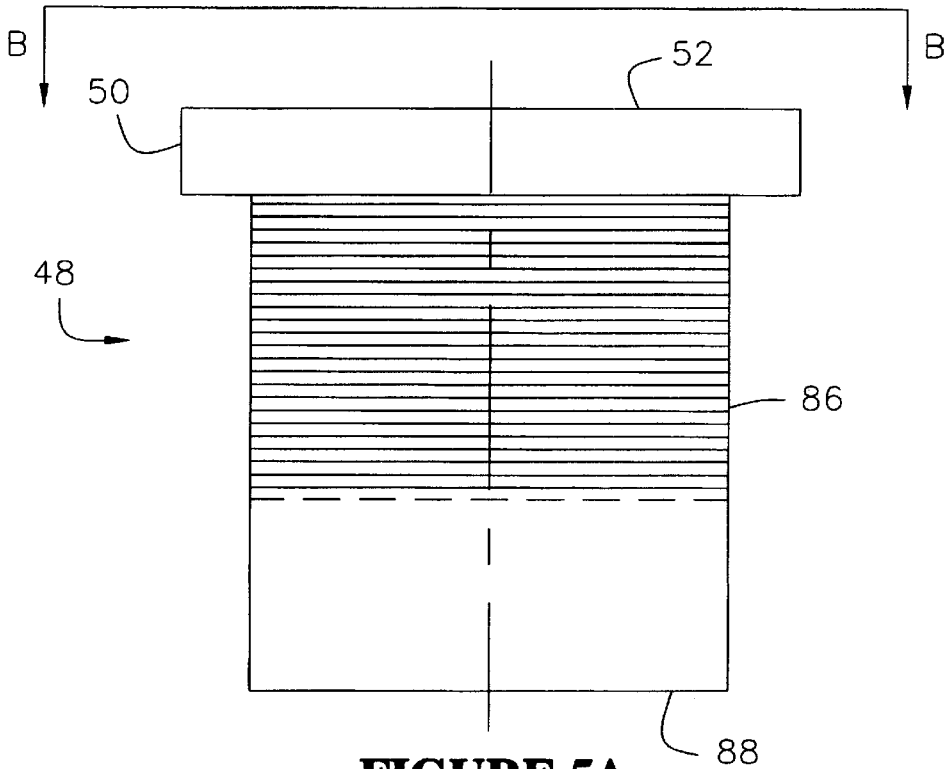

The pound cap 48 is also depicted in FIGS. 5A and 5B. The pound cap 48 will contain the flange top member 50 that includes the radial surface 52 that may be struck by hammer means for driving the novel pile 2 into the ground. The member 50 extends to the cylindrical surface 86, with the cylindrical surface 86 containing the packing for sealing with the inner diameter of the tubular member. The surface 86 concludes at the radial surface 88, and extends internally, so that the pound cap 48 may be placed over the end of the member 4 for driving. Once the pile 2 has been driven to the appropriate depth, the cap 48 may be removed, and the moving means maybe rotated in order to extend the blades in accordance with the teachings of the present invention.

In operation of the preferred embodiment, the method comprises striking the first end of the piling 2, namely the pound cap 48, with a conventional hammer means so that the v-cap 38 and tubular member 4 penetrates the ground until the desired depth is reached. The operator would then terminate the striking by the hammer means. The operator would then remove the pound cap 48 and turn the gripping member 62 of the first rod 10 so that the rod 10 rotates within the inner diameter 6 of the member 4. It should be noted that only one rod need be disposed within the inner diameter 6; however, in the preferred embodiment, two rods 10,12 are provided.

The rotation of the gripping member 62 may be accomplished by the turning of a wrench or other mechanical means to transfer torque, will in turn cause the plurality of blades (namely, blades 14–36) to pass through the plurality of passages contained within the member 4. It is possible to have as little as only one blade attached to the rods. The number of blades (as well as the number of rods) depends on the amount of compressive strength necessary for the specific job function that the novel piling 2 will be performing. The continued turning of the rods 10, 12 will urge the plurality of blades into the ground surface as depicted in FIG. 3B. In the preferred embodiment, the blades will protrude on two different sides of the member 4.

As noted earlier, the member 4 further contains a rod holder 40, operatively attached to the member 4, and wherein the rod holder 40 contains the second end of the rods 10, 12 within the projections. Hence, the step of turning the gripping end 62, 64 comprises rotating the rods 10, 12 within the rod holder. As noted earlier, there may be multiple rod holders spaced along the piling inner diameter to prevent bowing and properly orient the rods.

Also, the step of passing the blades through the passages includes passing the second section 72 through the passages 76 and the step of urging the blades includes urging the tip 74 into the ground surface as the second section 72 is rotated radially outward from the inner diameter 6. It should be noted that in the case where a locking groove is placed within the wall, the blades may be extended into said groove 79*a* so that the stability and strength of the blade and piling are increased.

According to the teachings of the present invention, It is possible to retract the blades so that the blades retract into the inner diameter. This may be accomplished by rotating the gripping member 62 and/or 64 in an opposite direction. By retracting the blades, the pile may be retrieved by conventional means.

Changes and modifications in the specifically described embodiments can be carried out without departing from the scope of the invention which is intended to be limited only by the scope of the appended claims.

I claim:

1. A piling comprising:

a tubular member having an inner surface with an inner diameter and an outer surface with an outer diameter with said tubular member having a first end and a second end, wherein said tubular member has an opening therein and wherein said outer surface with said outer diameter contains thereon a first locking groove;

a first rod disposed longitudinally within said inner diameter of said tubular member, said first rod having a first end and a second end;

a first blade attached to said first rod, said first blade having a first position contained within said inner diameter of said tubular member and a second position extended from said outer diameter, said first blade being aligned with said opening and wherein said first blade having a tip, said tip being configured to be inserted into said locking groove when said first blade is in said second position;

first rotating means, operatively attached to said first rod, for rotating said first blade from said first position through said opening and into said second position.

2. The piling of claim 1 wherein said first end of said tubular member contains a conical surface, and wherein said conical surface is adapted to be inserted into a ground surface.

3. The piling of claim 2 wherein said second end of said tubular member contains a cap body.

4. The piling of claim 3 wherein said first rotating means comprises a gripping surface on the first end of said first rod and a first rod holder adapted to hold the second end of said first rod and allow rotation of said first rod.

5. The piling of claim 4 wherein said tubular member further contains a plurality of openings and wherein the piling further comprises a plurality of blades, with said plurality of blades being aligned with said plurality of openings.

6. The piling of claim 1 wherein said tubular member contains a second locking groove and the piling further comprises:

a second rod disposed longitudinally within said inner diameter of said tubular member adjacent said first rod, said second rod having a first end and a second end;

a second blade attached to said second rod, said second blade having a first position contained within said inner diameter of said tubular member and a second position extended from said outer diameter, said second blade being aligned with a second opening contained within said tubular member, and wherein second blade has a second tip, said second tip being configured to be inserted into said second locking groove when said second blade is in said second position;

second rotating means, operatively attached to said second rod, for rotating said second blade from said first position through said second opening and into said second position.

7. The piling of claim 6 wherein said first end of said tubular member contains a conical surface, and wherein said conical surface is adapted to be inserted into a ground surface.

8. The piling of claim 7 wherein said second end of said tubular member contains a cap body.

9. The piling of claim 8 wherein said first rod further contains a third blade, and wherein said second rod further contains a fourth blade, and wherein said third and fourth blade are aligned with a third and fourth opening respectively contained within said tubular member.

10. A piling comprising:

an elongated hollow member containing an inner portion and an outer portion, said member containing a first end and a second end, and wherein said member contains a first plurality of passages therein and wherein said outer portion contains thereon a plurality of locking grooves;

a first rod longitudinally placed within said inner portion of said member, said first rod having a first plurality of blades attached thereon, said first plurality of blades being aligned with said plurality of passages, and wherein said first rod contains a first end and a second end;

a first gripping surface formed on said first end of said first rod, and wherein each of said first plurality of blades has a first tip, said tip being configured to be inserted into said locking groove when said first blade is in said second position;

a first rod holder operatively attached to said second end of said member, and wherein said first root holder containing said second end of said first rod so that said first rod may be rotated by a turning of said first gripping surface.

11. The piling of claim 10 wherein said member further includes a second plurality of passages, and wherein the piling further comprises:

a second rod longitudinally placed within said inner portion of said member and adjacent said first rod, said second rod having a second plurality of blades attached thereon, and wherein said second rod contains a first end and a second end, and wherein each of said second plurality of blades has a second tip, said second tip being configured to be inserted into said locking groove when said second blade is in said second position;

a second gripping surface formed on said first end of said second rod;

at least two second rod holders having said first rod and said a second rod holder having said second rod disposed therethrough, said second rod holder being attached to said inner portion of said member.

12. The piling of claim 11 wherein said first end of said member further comprises:

a pound cap positioned on said first end of said member, said pound cap being configured to allow pounding on said cap to drive said piling into a ground surface.

13. A method of driving a piling into a ground surface, the piling containing a tubular member having an inner surface with an inner diameter and an outer surface with an outer diameter and wherein said outer surface with said outer diameter contains a plurality of locking grooves, a first rod longitudinally place within said inner diameter of said tubular member, said first rod having a first plurality of blades attached thereon and wherein each of said first plurality of blades comprises a first section attached to said first rod, and a second section that extends from said first section, and wherein the method comprises:

striking a first end of the piling with a hammer means so that said tubular member is positioned at a desired depth;

terminating the striking by said hammer means;

turning a gripping surface of said first rod so that said first rod rotates within said inner diameter of said tubular member;

passing said first section and said second section of said first plurality of blades through a first plurality of passages contained within said tubular member;

urging said first section and said second section of said first plurality of blades into the ground surface;

extending a segment of said second section into said locking groove.

14. The method of claim 13 wherein said tubular member further contains a rod holder, operatively attached to a second end of said tubular member, and wherein said rod holder contains a second end of said first rod, and wherein the step of turning said gripping surface comprises:

rotating the second end of said first rod within said rod holder.

15. The method of claim 13 wherein said piling further comprises a second rod longitudinally placed within said inner diameter of said tubular member, said second rod having a second plurality of blades having a first section attached to said second rod, and a second section that extends from said first section and wherein the method further comprises:

turning a gripping surface of said second rod so that said second rod rotates within said inner diameter of said tubular member;

passing said first section and said second section of said second plurality of blades trough a second plurality of passages contained wit said tubular member urging said first section and said second section of said second plurality of blades into the ground surface;

extending a segment of said second section into said locking groove.

* * * * *